United States Patent [19]

Reker, Jr.

[11] 4,368,889

[45] Jan. 18, 1983

[54] GAME APPARATUS FOR SIMULATING SCHOOL EXPERIENCE

[76] Inventor: Louis M. Reker, Jr., 8501 N. 59th Ave., Glendale, Ariz. 85301

[21] Appl. No.: 281,127

[22] Filed: Jul. 7, 1981

Related U.S. Application Data

[63] Continuation of Ser. No. 17,475, Mar. 5, 1979, abandoned.

[51] Int. Cl.[3] ..... A63F 3/00

[52] U.S. Cl. ..... 273/243; 273/248

[58] Field of Search ..... 273/244

[56] References Cited

U.S. PATENT DOCUMENTS

| | | | |
|---|---|---|---|
| 2,273,009 | 2/1942 | Fischer | 273/243 |
| 2,757,933 | 8/1956 | Gilmour | 273/254 |
| 3,977,680 | 8/1976 | Lavine | 273/257 |
| 4,065,131 | 12/1977 | Martin, Jr. et al. | 273/243 |
| 4,216,971 | 8/1980 | Lyke | 273/243 |

FOREIGN PATENT DOCUMENTS

| | | | |
|---|---|---|---|
| 801964 | 9/1958 | United Kingdom | 273/243 |
| 1232602 | 5/1971 | United Kingdom | 273/243 |

OTHER PUBLICATIONS

*Wall St. Journal;* 4/1/1970, page unknown, "Games".
*Student Survival;* Sunsethouse Catalog; p. 4.

*Primary Examiner*—Richard C. Pinkham
*Assistant Examiner*—Scott L. Brown
*Attorney, Agent, or Firm*—Harry M. Weiss

[57] ABSTRACT

Game apparatus for simulating school experiences includes a game board having an outer path (the Promotion Path) around the periphery thereof from which a plurality of inner winding paths (School Paths) may be entered and exited. Associated with each School Path is a plurality of Benefit and Hazard Cards from which a player must draw when his playing piece lands on certain designated spaces in the School Paths. Additional spaces in the School Paths permit a player to direct another player to draw from a plurality of Influence Cards. Additional categories of cards (Promotional and Backtrack) are drawn by players at designated times, and movement of player pieces is dictated, in part, by the rolls of the dice. Additional hazards can be positioned by the players.

10 Claims, 1 Drawing Figure

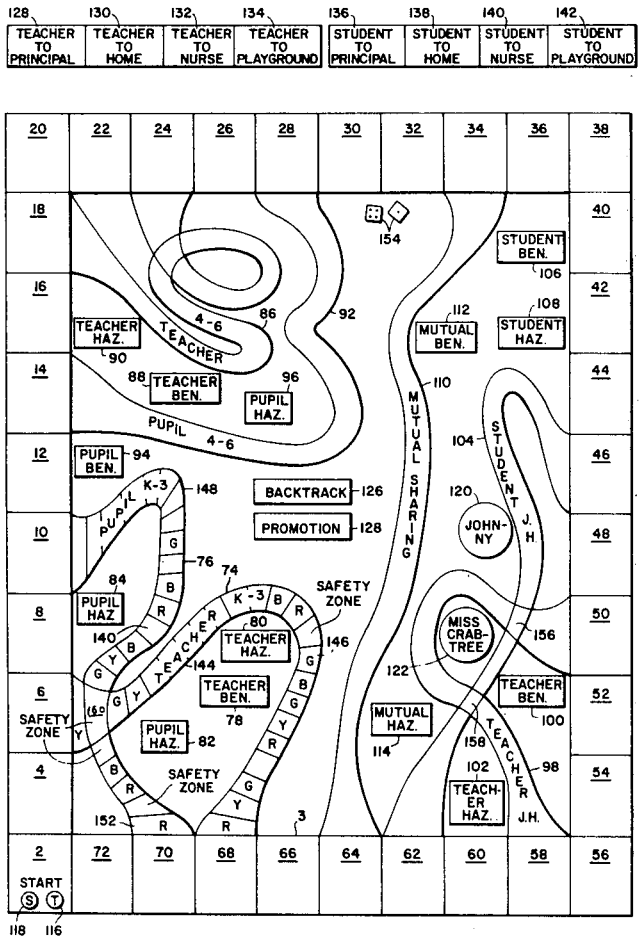

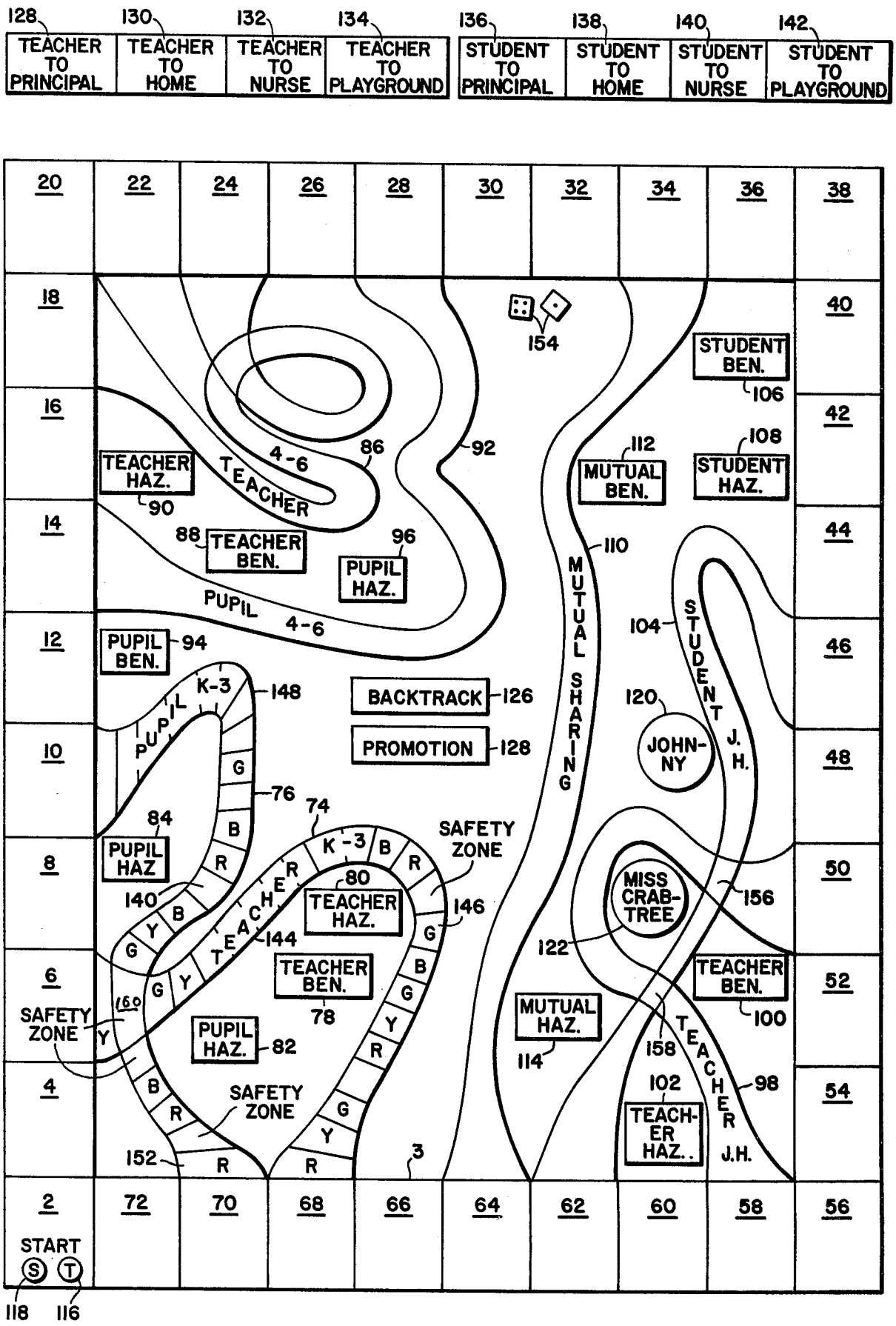
128 TEACHER TO PRINCIPAL
130 TEACHER TO HOME
132 TEACHER TO NURSE
134 TEACHER TO PLAYGROUND
136 STUDENT TO PRINCIPAL
138 STUDENT TO HOME
140 STUDENT TO NURSE
142 STUDENT TO PLAYGROUND
20 22 24 26 28 30 32 34 36 38
18 16 14 12 10 8 6 4 2
40 42 44 46 48 50 52 54 56
72 70 68 66 64 62 60 58
154
STUDENT BEN.
106
108
STUDENT HAZ.
112
MUTUAL BEN.
TEACHER HAZ.
90
4-6
TEACHER
86
92
88
TEACHER BEN.
96
PUPIL HAZ.
PUPIL 4-6
110
MUTUAL SHARING
104
STUDENT J.H.
PUPIL BEN.
94
K-3
148
PUPIL
BACKTRACK
126
120
JOHN-NY
PROMOTION
128
G
76
74
84
B
PUPIL HAZ
K-3
B
R
SAFETY ZONE
R
80
140
TEACHER HAZ.
146
MISS CRAB-TREE
156
Y
B
G
144
122
G
B
TEACHER BEN.
TEACHER BEN.
100
G
Y
160
G
Y
78
MUTUAL HAZ.
SAFETY ZONE
Y
PUPIL HAZ.
82
R
158
TEACHER
114
B
102
98
SAFETY ZONE
G
TEACH-ER HAZ..
J.H.
R
Y
152
R
R
3
START
S
T
118
116

GAME APPARATUS FOR SIMULATING SCHOOL EXPERIENCE

This application is a continuation of application Ser. No. 017,475, filed Mar. 5, 1979 and since abandoned.

BACKGROUND OF THE INVENTION

This relates generally to board game apparatus, and more particularly to a board game for simulating school experiences for both teacher and pupil at various academic levels.

School is an almost universal experience, and virtually everyone has either participated in it or has been in some way touched by it. Thoughts of it can trigger fond memories, feelings of frustration and anger, or yawns of sleepy indifference. The school experience is comprised of many aspects; e.g. academics, athletics, social exchanges, personal relationships, etc.

SUMMARY OF THE INVENTION

It is an object of the present invention to provide a board game which captures the diversity of the school experience and focuses on the two dominant roles of teacher and student.

It is a further object of the invention to provide a board game which, besides providing a framework for winning, also gives insight into the roles, values, desires and goals of both teacher, student and others within the school environment and perhaps a better understanding of the underlying institution.

The game is played by entering smaller internal winding paths on the game board (referred to as School Paths) and successfully exiting them to the Promotion Path which is a larger path extending completely around the periphery of the game board. Completion of a School Path is recorded, and the first player to complete a predetermined number of School Paths wins the game. For a short game, winning might require completion of three School Paths, two Teacher or Student Paths (depending on the role chosen) and a Mutual Sharing Path.

Before play, each player must select a role by selecting either a teacher or student game piece. Play is then governed (at least in part) by rolls of dice, and players proceed by moving their game pieces from the "START" position of the Promotion Path a number of squares corresponding to the number indicated by the dice. The Promotion Path contains certain regions from which the School Paths may be entered. An exact roll of the dice which results in landing on the entrance square is required before a School Path may be entered.

Hazard spaces are randomly positioned along each of the internal School Paths and provide obstacles to completion of the path. Hazard spaces are of a first color; e.g. red, on the game board, and when a player lands on a Hazard space he must draw a Hazard card from a stack of Hazard cards associated with that part.

Spaces of a second color (e.g. green) randomly positioned along each of the School Paths impart benefits to players who land on them. In this case, the individual player draws from a stack of Benefit cards associated with the particular path of travel.

Influence spaces (e.g. blue) are likewise randomly positioned along the School Paths, and landing on one of these squares permits the player to "influence" another player who has assumed a different role. The influencing player accomplishes this by directing the player to be influenced to draw from one of several stacks of Influence Cards. For example, a student landing on an Influence space might direct a teacher to draw an Influence Card from either the "Teacher to Principal", "Teacher to Home", "Teacher to Nurse", or "Teacher to Playground" stack. A teacher would direct a student to one of the student Influence stacks. All cards, whether Hazard, Benefit or Influence, should be read aloud.

A third category of spaces (e.g. yellow) are randomly positioned along the School Paths and instructions are contained thereon. A yellow space with no instruction is merely a neutral zone. A yellow space entitled "Safety Zone" frees the player who lands on it from the "Influence" of other players as long as he remains on that space.

When a player completes a School Path, he (1) credits himself with completion on his Record Card; (2) draws a Promotion Card or Backtrack Card (these may be subsequently used to move instead of rolling the dice since they indicate moves ahead or backwards respectively; and (3) moves Johnny or Miss Crabtree to a desired position on one of the School Paths. Johnny and Miss Crabtree are Hazard pieces. If a player lands on a space occupied by Johnny or Miss Crabtree, the player must withdraw from that School Path and return to the "START" square on the Promotion Path.

Thus, according to a broad aspect of the invention there is provided a school simulation game, imitative of teacher and student experiences wherein players can assume teacher and student roles comprising a game board having a substantially planar upper surface; a plurality of player game pieces; a chance device for partially determining movement of said game pieces on said game board; a plurality of hazard cards for impeding a recipient player's progress; a plurality of benefit cards for enhancing a recipient player's progress; a plurality of influence cards for altering a recipient player's progress; said game board including a first circuitous path of player movement delineated along the outer perimeter of said upper surface, said first path including a first plurality of successive player landing sites therealong having instructions thereon; and a plurality of inner paths each beginning and ending at one of said first plurality of landing sites, each of said inner paths including a second plurality of successive player landing sites, said second plurality including a first category directing a player to draw one of said hazard cards, a second category directing a player to draw one of said benefit cards, and a third category permitting a player to influence another player by directing said nother player to draw one of said influence cards.

BRIEF DESCRIPTION OF THE DRAWINGS

The above and other objects features and advantages will be more clearly understood from the following detailed description taken in conjunction with the accompanying drawing in which the sole FIGURE illustrates a game board and associated apparatus relating to the inventive school simulation game.

DESCRIPTION OF THE PREFERRED EMBODIMENT

Referring to the FIGURE, there is shown a game board 1 having a large path 3 called the Promotion Path around the periphery thereof. A plurality of teacher and student School Paths begin and terminate at specific squares in the Promotion Path. For example, the K-3

(kindergarten to third grade) teacher School Path 74 may be entered from square 6 of the Promotion Path and terminates at square 68 of the Promotion Path. Similarly, student School Path K–3 76 is entered from square 10 and terminates at square 70. Associated with teacher School Path 74 are stacks 78 and 80 of teacher Benefit and Hazard cards respectively. Likewise, associated with student School Path 76 are stacks of student Benefit and Hazard cards 82 and 84 respectively.

Teacher School Path 4–6 (grades 4–6) 86 is entered from square 24 and terminates at square 18. It has associated therewith stacks of teacher Benefit and Hazard cards 88 and 90 respectively. Student School Path 4–6 92 is entered from square 28, terminates at square 14 and has associated therewith stacks of pupil Benefit and Hazard cards 94 and 96 respectively.

Teacher School Path JH (Junior High) 98 is entered from square 50 of the Promotion Path, terminates at square 58 and has associated therewith stacks of Teacher Benefit and Hazard Cards 100 and 102 respectively. Student School Path JH 104 is entered from square 46 in the Promotion Path, terminates at square 62 and has stacks 106 and 108 of Student Benefit and Hazard Cards associated therewith.

An additional School Path 110 referred to as the Mutual Sharing Path may be entered or exited at either of squares 34 or 64 of the Promotion Path. It has associated therewith stacks 112 and 114 of mutual Benefit and Hazard Cards.

Additional game apparatus includes a plurality of player pieces comprising five teacher pieces each of a different color and five student pieces each of a different color. A teacher pieces and a student piece is shown at 116 and 118 respectively in the START square 2 of the Promotion Path. Model pieces of Johnny and Miss Crabtree should be placed in their respective positions at 120 and 122 respectively. Additional stacks of Promotion Cards 124, Backtrack Cards 126, Teacher Influence Cards 128, 130, 132 and 134 and Student Influence Cards 136, 138, 140, 142 are also shown in the FIGURE.

To successfully complete a conventional game of school, a player must first decide which role she or he wishes to play. If the player elects a teacher role, he will be required to complete all of the teacher paths 74, 86 and 98 (Kindergarten to Third Grade, Fourth Grade through Sixth Grade, and the Junior High Path). Besides this, he or she will also be required to complete the Mutual Sharing Path 110 and one of the Student Paths (76, 92 or 104). When an opposite role's path is run, the player must draw cards from that role's card stack including Benefit, Hazard and Influence Cards. In short, the player will have to successfully complete five of the seven School Paths.

If the player chooses a student role he must proceed in a similar manner except he will travel the Student or Pupil Paths for the three grade level segments. He will also be required to journey through the Mutual Sharing, and pass through a Teacher Role Path of his choice.

A teacher aspires to complete a successful year, and as a consequence, the paths are divided into segments of months such as is shown at 144 and 146. The student proceeds down paths that are divided into grade levels such as is shown at 148, 150 and 152 with the final goal being graduation. The game does not demand a particular sequence in which the player must complete certain paths first before going to others. It is conceivable and even probable that an individual may begin the game at a 4–6 or Junior High Path. The object of the game is to travel paths, and upon completing them, to acquire and record the experience. With five such experiences a player wins a conventional game.

Before starting a game, each player should have a Record Card on which he or she can account for each path completed, and also make a record of any benefit or hazard he must account for. While playing the game, the player should continuously check his Record Card and mark any appropriate spaces.

At the bottom of the Record Card are four blank playing cards, entitled Teacher Hazard Card, Teacher Benefit Card, Student Hazard Card and Student Benefit Card. Before starting the game, the players should decide as to whether or not they should write their own unique hazard and benefits cards. If they decide to do this, they should cut this section off and divide it into its four cards. The players can write their own penalties and advantages. On the Hazard Cards they should indicate a move backward of one to five spaces, and the opposite should be presented on the Benefit Cards, showing a move forward of one to five spaces. The severity of the hazard and degree of advantage of the benefit should be the factors in assigning a specific number of moves to the cards. As players acquire more experience with the game they can perhaps create other procedures besides the forward and backward movements. Upon completion of the cards they should be randomly inserted in the Hazard and Benefit stacks.

The Promotion Path 3 is the means by which the player gains access to or departs from the school paths. Successfully negotiating this path is an essential part of the game. Travel along the path is controlled by a roll of dice shown at 154. The number appearing on the exposed horizontal faces of the dice is the exact number of spaces a player must move. In order to enter a school path, the player must roll the exact number that will take him to the beginning of the School Path. Certain promotion path squares can advance a player to a School Path as can the use of a Promotion Card or Backtrack Card. These cards are an alternative to rolling dice. They give the player a move of either one, two or three spaces backwards or forwards and are acquired when a path is completed. It should also be noted that these or any Hazard, Benefit or Influence Cards, if they remain in the possession of a player, can be traded. When entering the Promotion Path from a School Path, one is required to travel the exact number of spaces that appears on the dice. For example, if the number six is rolled and there are only two squares remaining on the School Path, the player must then proceed in a clockwise direction for four spaces down the Promotion Path.

The following is a detailed explanation of the various Promotion Path squares:

Labor Day and Lincoln's Birthday (squares 4 and 36)—On these squares you are credited with a Promotion Card or a Backtrack Card.

Begin the Path and Exit the Path (e.g. squares 10 and 70) The beginning square provides an opportunity to start and complete one of the five essential paths to win a conventional game. These squares are neutral and if a player lands on such a square he may begin the School Path or move on with his next turn. Exit squares are also neutral.

The Field Day and Week End squares (22 and 42 respectively) provide the player with another turn, and Monday and Halloween (squares 8 and 52 respectively, freeze the player with a loss of turn.

Cross Board Squares 12 and 44 can be used in two ways. The player can elect to stay on the square, or jump completely across the board. This will depend on each player's strategy and needs.

George Washington's Birthday 16 or Recess 40—The player receives a Promotion Card on George's Birthday and Backtrack Card on Recess. Either of these cards can be used on the Promotion Path and School Paths.

Detention Time 20 and Sick Day 38—Both squares detain a player unless he rolls less than six or doubles provided, however, that on the third roll the player can leave these squares regardless of whether he has rolled more or less than 6, or doubles. Promotion or Backtrack Cards can also be used to escape.

Advance Paths (26, 54, 66) give a player an immediate opportunity to begin on a Junior High, 4–6, or K—3 path. If the player does not need to make the advance he may remain on the advance square. Remember, even if the designated School Path to which the player is directed has been completed, he still must complete one path of the opposite role to win a conventional game.

Christmas Break 32 frees a player of Hazards on the Promotion Path or any School Path he completes before getting past START (Square 2). This, however, does not free him of "influence" from another player, nor does it release him from the instructions on the above referred third category of spaces. The player simply need not draw a Hazard Card when he lands on a red space in a School Path.

Suspension 60, Double Hazards 30, Spring Break 48 and Double Benefits 72 all give benefits and liabilities for the next School Path that one takes. Double Hazards can be escaped by sacrificing a one space Promotion Card and moving to Christmas Break 32. The above mentioned Promotion Squares, along with Christmas Break are all one time affairs. If a player lands on them again, they become merely neutral spaces. For this reason, it is necessary that each player keep an accurate record on his or her Record Card.

For the sake of completeness, the following is a list of the indicia on the Promotion Path squares along with their numerical designations

2 START;
4 Labor Day—collect a Promotion Card or a Backtrack Card;
6 Teaching Path—begin K–3;
8 It's Monday—you lose a turn;
10 Pupil Path—begin K–3;
12 Cross Board Move;
14 Pupil's Exit 4–6, check your Record Card;
16 George Washington's Birthday, acquire 1 Promotion Card;
18 Teacher's Exit 4–6, check your Record Card;
20 Detention, roll less than six or doubles to leave;
22 Week End—double turn;
24 Teaching Path—begin 4–6;
26 Advance to Junior High Path;
28 Pupil Path—begin 4–6;
30 Double Hazards—next path draws 2 cards at each red square;
32 Christmas Break—you have no more Hazards until you pass START;
34 Mutual Sharing—enter or exit—check your Record Card;
36 Lincoln's Birthday—collect a Promotion Card or a Backtrack Card;
38 Sick Day—roll more than six or doubles to leave;
40 Recess—acquire one Backtrack Card;
42 Field Trip—double turn;
44 Cross Board Move;
46 Student Path—begin Junior High;
48 Spring Break—you have double influence on your next path;
50 Teaching Path—begin Junior High;
52 It's Halloween—you lose a turn;
54 Advance to your *K*–3 path;
56 Summer Vacation—advance to the path you need;
58 Teacher's Exit—Junior High—check your Record Card;
60 Suspension—you have no influence on your next turn;
62 Student Exit—Junior High—check your Record Card;
64 Mutual Sharing—enter or exit—check your Record Card;
66 Advance to your 4–6 path;
68 Teacher Exit—K–3, check your Record Card;
70 Pupil Exit—K–3, check your Record Card;
72 Double Benefits—next path draw two Benefit Cards at each green square.

School Paths must be completed to win and the spaces of them describe numerous school related experiences. To travel the School Paths, the players must again roll dice or use Promotion or Backtrack Cards, and proceed to the enumerated space.

Hazard spaces are colored red (R in FIG. 1) and they will always involve a penalty placed on a player. When a player lands on one of these squares, he must draw a Hazard Card, read it aloud and then follow the instructions on it. The card will contain a Hazard statement that is typical of the area (grade level), and instructions that will indicate the deprivation of something, or a move backward on the appropriate path. When the instructions have been fulfilled (with this or any other group of cards) the card is placed at the bottom of the stack, unless that card specifically requires retention. If so, the card is retained until the player finds reason to use it. It is then placed at the bottom of the appropriate stack.

Benefit spaces are colored green (G in Figure) and always provide the player with an advancement along the path or a positive advantage later in the game. The cards contain a comment on school and specific instructions which the player must read aloud.

When a player draws a Hazard or Benefit Card and moves to another space and that space is red or green, the player need not draw another card. He also need not follow the instructions on the yellow spaces except that while in a safety zone, the player will be free of influence from an opposite role player. Neutral yellow spaces (Y in Figure) (those without instructions) draw no penalties, benefits or special considerations. The yellow spaces with instructions indicate loss of turn, a double turn, information or a safety zone.

Blue spaces (B in Figure) provide an opportunity for the teacher-players and student-players to influence each other. When a player lands on a blue space, he directs an opposite-role-player, teacher if he is a pupil; or pupil if he is a teacher; to draw one blue card from one of the Influence stacks i.e. Home (130 and 138), Principal's Office (128 and 136), Nurse (132 and 140) or Playground (134 and 142). He has complete freedom in selecting anyone as long as the player is operating in a role opposite to his. The only exception to this resides in the Mutual Sharing area wherein the player can direct anyone in that section to an Influence Card stack. If a player draws a negative card, he can escape its consequences by casting the dice. If the numbers 3, 7 or 11 appear, the person who directed him to the blue card must suffer its penalties, and the person who was directed must stand pat. Also, if a player lands on a blue space and none of the opposite role players are on School Paths, or if they are on Safety Zones, then that player has no "influence" on that square. If a player lands on a double blue space, the above rules apply except that the player directs two players to Influence Card stacks. In this role he may direct two players to the same or different categories, and he may also direct which player is to go first. Both players have the right to roll dice to try to escape a negative consequence. This leaves the director-player vulnerable twice. There are a few instances (the result of a Benefit Card move) when a player can influence three (or four) opposite role players. The effect of a Hazard Card that indicates loss of influence at the next blue square is cancelled by a "double influence at the next blue square" Benefit Card. Both cards should be returned to their proper stacks.

Both player roles have the opportunity to manipulate two board figures—Miss Crabtree and Johnny. They are the most severe hazards of the game. If a player lands on a space occupied by either, the player's advancement stops and he must retreat back down the School Path and then return to the start of the Promotion Path.

Only players in the teacher role manipulate Miss Crabtree, and she can be placed on any student-pupil path. Johnny is regulated by the student-role players and he is placed on Teacher Paths. Players can position Johnny or Miss Crabtree when the player completes a School Path. Both board figures can be placed on Mutual Sharing spaces, and both roles are subject to both characters at the two Junior High intersections 156 and 158, and the K-3 intersection 160. Whatever square they are placed on is automatically changed.

When a player exits a School Path to the Promotion Path, he is then required to do three things; 1. Check his Record Card for a completed path; 2. Collect a Promotion Card or Backtrack Card; and 3. Move Miss Crabtree or Johnny to any desired square on a School Path.

The following is a list of Hazards, Benefits and Influence information which is presented in the designated stacks of cards:

MUTUAL HAZARDS

1. School Epidemic—Flu hits everybody. (Move back to the last player in your area)
2. Teachers or Students Strike. (At your next Hazard square draw 2 cards)
3. School Fire—(At your next Hazard square draw 2 cards)
4. Power Cut Off from Bad Weather—(Move back 2 spaces)
5. Sulfur Bomb is placed in the ventilation system—Evacuate the school. (Move back 4 spaces)
6. Lice are found on 15% of the student body. (Move back 3 spaces)
7. In this age of "plenty" you learn that four students are chronically hungry. (Move back 5 spaces)
8. Your school spends four days on a new battery of achievement tests. (At your next blue square you will have no influence)
9. Principal announces that the school population will be split up due to a District Change. Students and Teachers are transferred. (Go back to the beginning of the path)
10. School Heating System fails during mid-winter. (Move back 1 space)

MUTUAL BENEFITS

1. You and the class enjoy a stimulating group discussion. (Move forward 3 spaces)
2. The Field Trip is a complete success and everyone returns happy. (Move forward 5 spaces)
3. The whole school has a good time during Track and Field Day. (No sunburns). (Move forward 4 spaces)
4. Students and chaperones enjoy a successful Spring Dance. (Move forward 2 spaces).
5. The Christmas Party is a smash—nobody turns over the punch bowl. (Move forward to the lead player in your area)
6. Everybody enjoys a Comedy Film Festival. (At your next Hazard square you will not have to draw a card)
7. The cafeteria serves fried chicken just like the "Colonel". (Move forward 1 space)
8. The class "entertainer" has everyone in stitches. (Move forward 4 spaces)
9. The principal announces a surprise Half Day Schedule. (At your next blue square, you may influence two players—if double—you influence three or four)
10. Two days are added to the Christmas and Easter Breaks. (You get another turn; however, you cannot draw cards where you land)

PUPIL HAZARD CARDS (K-3)

1. You drop your lunch tray in the cafeteria. (Move back 2 spaces)
2. It rains for a week and the playground becomes a swamp. (Move back to the last player in your area)
3. The 250 lb. Science teacher doesn't see you and steps on your toe. (you lose your next turn)
4. You become sick on a field trip. (Move back 3 spaces)
5. You eat a box of Valentine candy and become ill. (No more benefits for the rest of the path)
6. You lose your name tag on the first day of school. (Move back 5 spaces)
7. You are so frightened by school, you wet your pants. (Move back 5 spaces)
8. Your substitute teacher is the "Wicked Witch of the West". (Move back 4 spaces)
9. The teacher frowns at you the whole day and you don't know why. (At your next blue square you will have no influence on the teacher role)
10. The teacher frowns at you the whole day and you do know why. (Move back to the nearest grade level)

TEACHER HAZARD CARDS (K-3)

1. You overhear two third grade girls muttering obscenities and you regret their loss of innocence. (Move back 5 spaces)
2. Your burn the cookies for a class demonstration. (Move back 3 spaces)
3. A pupil throws up in your room. (Move back 4 spaces)
4. You raise your voice in anger and half of the class begins crying. (Move back to the nearest month)
5. You slide projector jams and you can't find a replacement. (Move back to the last player in your area)

6. Salary negotiations break down and there is the possibility of a strike. (At your next hazard square draw 2 cards)
7. 'Mother Gerbil' devours one of her babies while the whole class is watching. (You lose your next turn)
8. You step out of your class for a minute and when you return the group is "rowdy". (Move back 2 spaces)
9. Your children refuse to listen today. (At your next blue square you'll have no influence)
10. One of your children breaks the aquarium. (Move back 1 space)

PUPIL BENEFIT CARDS (K-3)

1. You pass the Third Grade Reading Test. (Move forward 5 spaces)
2. You get Valentines from all members of the class. (Move forward 4 spaces)
3. The most attractive teacher in the school hugs you and praises your work. (At the next red Hazard square you will not have to draw a card)
4. You get chocolate milk for three days straight. (Move forward 2 spaces)
5. Everyone claps for your "show and tell" project. (You get another turn; however you cannot draw cards on the space where you land)
6. You eat a box of Valentine candy and don't become ill. (Move forward 3 spaces)
7. You get a fresh set of crayons and new coloring books. (Move forward 1 space)
8. All of the new baby gerbils are pink and happy. (Move forward to the next grade level)
9. You're selected to feed the aquarium fish. (Move forward to the lead player in your area)
10. You get to take the class pet home for the weekend. (You are freed of Miss Crabtree)

TEACHER BENEFIT CARDS (K-3)

1. Your pupils score well above the national "norm" on their reading tests. (Move forward to the next month)
2. You're feeling a little ill and your classes are quiet and helpful the whole day. (Move forward 4 spaces)
3. Your reading group is enthusiastic and eager to learn. (Move forward to the lead player in your area)
4. A "troublesome" pupil "comes around". (You get another turn; however you cannot draw cards on the space where you land)
5. You observe that one of your "immature" children begins to grow up. (No more hazards for the rest of the path)
6. Not one child "tattles" during play time. (Move forward 3 spaces)
7. Children share without being asked to. (At your next blue space you may influence two players—if a double blue—you influence three)
8. Your children befriend the "misfit". (Move forward to the lead player in your area)
9. A disturbed child is finally sent to a special program. (Move forward 5 spaces)
10. You're freed of playground lunch duty for two weeks straight. (Collect two cards at Lincoln's Birthday or Labor Day)

PUPIL HAZARD CARDS (4-6)

1. You're attacked by eighth grade students. (Move back to the last player in your area)
2. You can't sit by your best friend. (You lose your next turn)
3. A member of the opposite sex tries to kiss you. (No more benefits for the rest of the path)
4. Somebody steals your jump rope. (Move back 1 space)
5. The teacher makes you stand in the corner. (At your next blue space you will have no influence on the opposite role)
6. An upper grader steals your ball. (Move back 4 spaces)
7. The class bully punches you in the nose at the bus stop. (You lose a promotion card)
8. No one will let you borrow paper for a test. (Move back 2 spaces)
9. You get detention Friday afternoon just before going camping. (Move back 5 spaces)
10. You receive a major homework assignment just before the Easter Holiday. (Move back to the nearest grade level)

TEACHER HAZARD CARDS (4-6)

1. The next door substitute teacher abandons her classroom and the group is running wild in your area. (Move back 5 spaces)
2. A student has a tantrum and kicks you in the shin. (You lose a promotion card)
3. Parent attacks your integrity at a conference. (Move back to the nearest month)
4. Parent attacks your integrity in the classroom. (You lose your next turn)
5. Your principal evaluates you on the worst day of the year. (At your next blue space you will have no influence on an opposite role)
6. Your schedule shows that you have three duties the same week. (Move back 3 spaces)
7. Your class shows vicious cruelty to a new student. (Move back to the last player in your area)
8. Your classes are "antsy" all day and you don't know why. (Move back 4 spaces)
9. Everyone got "lost" on your outdoor education adventure. (Move back 2 spaces)
10. A "radical" parent group is about to inspect your class. (Move back 5 spaces)

PUPIL BENEFIT CARDS (4-6)

1. There is a cartoon festival just before the Christmas Holiday. (At your next Hazard space you will not have to draw a card)
2. The teacher rearranges the seating plan and you are now by your two closest friends. (Move forward to the lead player in your area)
3. You are praised for your excellent social studies project. (Move forward 3 spaces)
4. In a school contest you win four passes to the Saturday afternoon movies. (Move forward 1 space)
5. You and your friends get to help the P.E. Coach for half the day. (You get another turn; however you cannot draw cards on where you land)
6. You are selected for a special camping field trip. (Move forward 4 spaces)
7. The short story you read in class makes a lasting impression. (Move forward 2 spaces)
8. You think you finally understand fractions. (Move forward 5 spaces)
9. Your teacher becomes a real friend and you feel he understands you. (Complete this path and go to Summer Vacation)
10. Your friends don't laugh at you when you're embarrassed in class. (At your next blue square you may influence two players—if a double blue—you influence three)

TEACHER BENEFITS (4–6)

1. There are no "tattle tales" in your homeroom. (No more Hazards for the rest of the path)
2. Several of your pupils become helpful aids. (You get another turn; however you cannot draw cards on where you land)
3. Your lesson strategies and plans are more effective than ever. (Move forward to the next month)
4. You get a letter from a student you had five years ago. (Move forward 1 space)
5. A slow reader is beginning to show progress. (Move forward to the lead player in your area)
6. The district has finally approved a major salary increase. (At your next blue space you may influence two players—if a double blue—you influence three)
7. You get a "professional" day for a special conference. (Move forward 3 spaces)
8. You get dental benefits in your next contract. (Move forward 4 spaces)
9. Your district budget override passes. (Move forward 5 spaces)
10. Three of your "super" students visit you after school. (You are freed of Johnny)

STUDENT HAZARD CARDS (JH)

1. You break out in pimples before the school dance. (Move back 3 spaces)
2. You are caught smoking in the Rest Room. (Move back 4 spaces)
3. You are paddled for misbehavior—your best friend's. (Move back 5 spaces)
4. You have "on school suspension" in the Janitor's Office and he smokes cigars all day. (Move back 2 spaces)
5. You're called on to recite and you're at the wrong place. (At your next blue square you'll have no influence)
6. You've just completed a major math exercise and you've multiplied all problems when you should have divided. (Move back to the last player in your area)
7. You fall on your face while getting your diploma. (Go back to the beginning of the path)
8. You get braces just before Halloween. (Move back 1 space)
9. You catch "mono". (Move back to the nearest month or grade level)
10. You're caught copying your neighbor's paper. (You lose your next turn)

TEACHER HAZARD CARDS (JH)

1. You pop out your pant's bottom in a sporting activity. (Go on a diet). (Move back 4 spaces)
2. Your student teacher "freezes" on his first teaching attempt. (No more benefits for the rest of the path)
3. An irate student cracks your car window with a rock. (Move back 5 spaces)
4. A student asks you for a date—and is serious. (Move back 1 space)
5. Students are "rowdy" before vacation. (At your next blue square you will have no influence)
6. You give directions fifty times in one class—and you can't figure out why. (Go back to the beginning of the path)
7. You've lost your grade book. (Move back to the last player in your area)
8. One of your students is spending most of his time trying to provoke you. (You lose your next turn)
9. Your next door teacher is a "screamer" and he's driving you up the wall. (Move back 3 spaces)
10. After a night of celebration teaching becomes difficult. (Move back 2 spaces)

STUDENT BENEFIT CARDS (JH)

1. You catch laryngitis before your class speech. (Move forward 3 spaces)
2. The cutest (girl or boy) asks you to the Spring Dance. (You have no more Hazards for the rest of the path)
3. You win tickets in a school contest to your favorite professional team. (Move forward one grade level or month)
4. Your substitute teacher has a neat bag of tricks. (Move forward 2 spaces)
5. You pass all of your classes with 1's. (You get another turn; however you cannot draw cards on where you land)
6. You are named athlete of the year. (Move forward to the lead player in your area)
7. You are valedictorian of the graduating class. (Move forward 2 spaces)
8. Your popularity has greatly increased (especially with the opposite sex). (At your next Hazard square you will not have to draw a card)
9. You take four awards at the Honors Assembly. (Move forward 4 spaces)
10. Your favorite teacher takes you to lunch. (Move forward 5 spaces)

TEACHERS BENEFIT CARDS (JH)

1. You students are bright and responsive. (Move forward to the lead player in your area)
2. Your new schedule allows you almost twice as much "prep" time. (Move forward 4 spaces)
3. Your special "elective" class is really excited by your innovative teaching. (Move forward 3 spaces)
4. Your student teacher is a "natural". (Collect two cards at Lincoln's Birthday or Labor Day)
5. You get to know your students on a personal and human level. (Complete your path and go to Summer Vacation)
6. Your class load is reduced to twenty-five students. (Move forward 2 spaces)
7. Your class load is reduced to fifteen students. (At your next Hazard square you will not have to draw a card)
8. Several of your students show signs of being talented writers. (Move forward 2 spaces)
9. You win you special request for a new reading program. (Move forward 5 spaces)
10. Your cross age teachers are very successful. (You get another turn; however you cannot draw cards on where you land)

INFLUENCE CARDS (STUDENT TO HOME)

Negative

1. Two fives appear on your report card. You're grounded for a month. (At your next Hazard square draw two cards)
2. Your parents have a fight and you can't think about anything else for the rest of the day. (Move back 5 spaces)
3. You catch your sister's flu. Stay home for the rest of the week. (Move back 4 spaces)

4. You have double chores for misconduct at school. (At your next blue square you'll have no influence)
5. For being late to school you can't watch your favorite T.V. show. (Move back 3 spaces)
6. After your teacher talks with your parents, you can't attend special school activities for a month. (Draw a Hazard Card from your current area)

Positive

1. You're above average in all grades. You're rewarded with double allowance. (At your next Hazard square you will not have to draw a card)
2. You receive a motorcycle for Christmas. (Move forward 4 spaces)
3. For good grades you get a month's vacation in the mountains. (Draw a Benefit Card from your current area)
4. Your parents change their plans to move. (Move forward 5 spaces)

INFLUENCE CARDS (STUDENT TO PRINCIPAL)

Negative

1. You've been retained for another year for chronic absenteeism. (Move back 5 spaces)
2. You've been suspended for misconduct. (Draw a Hazard Card from your current area)
3. You teacher takes you to the Principal's Office to call home for misbehavior. (At your next Hazard square draw 2 cards)
4. You get detention for a week. (At your next blue square you'll have no influence)
5. The principal keeps you in his office all day—and it is not because he likes you. (Move back 4 spaces)
6. You've been acting up too much and the principal calls in your parents. (Move back 3 spaces)

Positive

1. You've been selected student of the month. (At the next Hazard square you will not have to draw a card)
2. You've made the principal's honor roll. (Move forward 5 paces)
3. You've won top prize in the school's magazine drive contest. (Move forward 4 spaces)
4. The principal recognizes your exceptional work on helping other students. (Draw a Benefit Card from the area in which you're playing)

INFLUENCE CARDS (STUDENT TO NURSE)

Negative

1. Nurse recommends that you see a doctor to have your tonsils removed. (Draw a Hazard Card from your current area)
2. Nurse gives you an ice pack for a stomach ache. (Move back 4 spaces)
3. Nurse misplaces your medicine and you're sick all day. (Move back 5 spaces)
4. You "wipe out" on your mini-bike. (At your next Hazard square draw two cards)
5. You get your foot caught in the door. (Move back 3 spaces)
6. You break your finger playing baseball. (At your next blue square you have no influence)

Positive

1. Nurse sends you home and you're not sick. (Move forward 5 spaces)
2. Nurse concludes that you need to spend the rest of the day out of class. (Move forward 4 spaces)
3. You enjoy a friendly chat with the nurse and she gives you her best cough drops. (Draw a Benefit Card from the area in which you're playing)
4. The nurse provides you with a comfortable bed for the rest of the day. (At your next Hazard square you will not have to draw a card)

INFLUENCE CARDS (STUDENT TO PLAYGROUND)

Negative

1. You fall from the "monkey bars" and break your arm. (At your next Hazard square draw two cards)
2. You're pushed into the only remaining mud puddle on the school grounds. (Move back 4 spaces)
3. You're picked last for football. (Move back 5 spaces)
4. They say you're too small to make the basketball team. (Draw a Hazard Card from your current area)
5. The coach puts you down for not "dressing out". (At your next blue square you have no influence)
6. You catch an elbow in the mouth during football practice. (Move back 3 spaces)

Positive

1. You win the baseball game by scoring the final run. (At your next Hazard square you will not have to draw a card)
2. You're chosen captain of the volleyball team. (Move forward 5 spaces)
3. Your playground gets new equipment—and you've had a choice in what was selected. (Draw a benefit card from your current area)
4. You play basketball with your favorite teacher. (Move forward 4 spaces)

INFLUENCE CARDS (TEACHER TO HOME)

Negative

1. You're too "run down" to come to school the next day. (Draw a Hazard Card from your current area)
2. You're tired and you have an argument with your spouse. (At your next Hazard square draw two cards)
3. You grade papers and 50% of your students fail. (Move back 5 spaces)
4. Your car breaks down before going to school. (Move back 4 spaces)
5. You receive a 2% raise with 12% inflation. (At your next blue square you'll have no influence)
6. You fail your night class. (Move back 3 spaces)

Positive

1. Your spouse gets a raise. (At the next Hazard square you will not have to draw a card)
2. You get a raise on your "moonlight job". (Draw a Benefit Card from your current area)
3. You grade papers and a large percentage of students do a superior job. (Move forward 5 spaces)
4. Your own children are enjoying success in school. (Move forward 4 spaces)

INFLUENCE CARDS (TEACHER TO PRINCIPAL)

Negative

1. Principal informs you that your class load will increase to 37 pupils. (At your next Hazard square draw two cards)

2. Principal informs you that your class load will increase to 47 pupils. (Draw a hazard card from your area)
3. You're reprimanded for being too rough on a student. (Move back 4 spaces)
4. To your astonishment after several sessions with your principal, you discover he has invented a new language with no specific meanings. (Move back 5 spaces)
5. The principal has changed your class schedule for the fourth time. (Move back 3 spaces)
6. There is no new money to buy classroom materials. (At your next blue square you have no influence.)

Positive

1. You are commended for your PTO Support. (Move forward 5 spaces)
2. You are evaluated as a "superior" teacher in almost all areas. (At your next Hazard square you will not have to draw a card)
3. Your principal supports your new teaching idea. (Move forward 4 spaces)
4. An irate parent attacks you, but your principal supports you. (Draw a benefit card from your current area)

INFLUENCE CARDS (TEACHER TO NURSE)

Negative

1. The nurse informs you that your "top" academic student will be out for the rest of the year. (At your next Hazard square draw two cards)
2. You have a headache and the nurse is out of aspirins. (Move back 3 spaces)
3. A student breaks his arm while you're on duty. (Draw a Hazard Card from your current area)
4. Your are pegged in the eye with a "spit-wad" and you're seeing double. (Move back 5 spaces)
5. You get an unexpected nose bleed in class and the nurse bandages you for major surgery. (Move back 4 spaces)
6. The nurse informs you that you've been exposed to a contagious disease. (At your next blue square you'll have no influence)

Positive

1. You learn that one of your chronically ill students is regaining his health. (Draw a benefit card from your current area)
2. The nurse's recommendation gets glasses for a troubled student. (At your next Hazard square you will not have to draw a card)
3. Your nurse is the school comedian and her material is better than ever. (Move forward 4 spaces)
4. The nurse provides helpful and timely council for your students. (Move forward 5 spaces)

INFLUENCE CARDS (TEACHER TO PLAYGROUND)

Negative

1. Two students get into a fight while you're on duty. (At your next blue square you'll have no influence)
2. It begins to rain while you're on duty and you can't find your class key. (Move back 4 spaces)
3. When you break up a playground fight, you're bitten by one of the warriors. (Draw a Hazard Card from your current area)
4. You race with your children and learn how much weight you've really put on. (At your next Hazard square draw two cards)
5. You are clobbered by a line drive hit. (Move back 5 spaces)
6. You rip the new shirt you bought last week. (Move back 3 spaces)

Positive

1. You observe that some children are showing real leadership in organizing games. (Move forward 4 spaces)
2. You enjoy a friendly chat with two of your "quiet" students. (Move forward 5 spaces)
3. You quarterback the boys football team and throw three touchdown passes. (At your next Hazard square you will not have to draw a card)
4. You observe that a new pupil is accepted by the group. (Move forward 4 spaces)

If a benefit card advances you to a space where Johnny or Miss Crabtree are located, you are still subject to the following Benefits:

1. Move forward one grade level or month—If you draw this benefit and there are no grade levels or month in front of you, you must stand pat.

2. You get another turn, however, you cannot draw cards on where you land. You still have the power of influencing another player if you land on blue, and you can enjoy the protection of the yellow safety zone.

3. At your next Hazard square you will not have to draw a card. This (Keep) card must be used at your next Hazard square and returned to its appropriate stack. You may, however, trade this or any card in your possession before you arrive at a Hazard square.

4. At your next blue square you may influence two players—if a double blue, three (or four) players are influenced. This is nullified, if you acquired Spring Break 48 or Suspension 60 before entering a School Path.

5. Moved forward to the lead player in your area. If you are the lead player on your path, stand pat.

6. No more Hazards for the rest of the path. If you have landed on Double Hazards for the next path this card will free you of that responsibility for the balance of the School Path you're traveling. You are still subject to the influence part of the game.

7. You are freed of Miss Crabtree and Johnny. These (Keep) cards can only be used when you land on Miss Crabtree or Johnny. It is the only occasion where a player can share the same space with either of these "Hazards". If this happens, the card must then be returned to the stack, where it was taken.

8. Collect two cards at either Lincoln's Birthday or Labor Day. This can be two Promotion cards or two Backtrack Cards, or a combination of one of each.

No Hazard or group of Hazards can send a player back to the Promotion Path. He may only be sent as far back as the first yellow space of his School Path. The only exceptions to this are, of course, if a player lands on a space occupied by Miss Crabtree or Johnny. In that case he is pushed back to the start of the Promotion Path. If that player has successfully traveled other paths prior to this, he does not lose credit for those.

Certain Hazards deserve additional explanation.

1. At your next Hazard square draw two cards. This is nullified if the player has checked Double Hazard the Next Path 30 on his Record Card.

2. At your next blue square you'll have no influence. Return this (Keep) card to the stack if you're operating under Suspension 60 or Spring Break 48.

3. Move back to the nearest month or grade level. If there are no grade levels or months behind the player, he should retain his original position.

4. Move back to the last player in your area. If the recipient is the last player on your path, he should stay where he is.

5. No more benefits for the rest of the path. If one draws this card he may not pull from the green stacks for the balance of the School Path. This card will nullify the advantage given by Double Benefits 72.

A suggested format for the Record Card would include a space for the player to insert his name and additional areas to check-off (1) paths completed; (2) Promotion Path Benefits (Christmas Break, Spring Break, Double Benefits for a Path); and (3) Promotion Path Hazards (Suspension and Double Hazards for one Path). As described above, additional areas should be available for hte players to tailor their own Benefit and Hazard Cards.

A short game consists of completion of three paths, and a conventional game consists of completion of five paths. However, other variations are possible. For example, it is possible for individuals to play a long game where they first complete one role, and move to the other, thereby traveling all seven paths. A suggested format for this would be to run the pupil paths first, travel Mutual Sharing, assume the teacher role, and then complete the three remaining teacher paths.

If desired, two players can opt to manipulate two (or perhaps more) pieces within each role with the winner being the individual who first successfully runs all of his pieces through the necessary paths. Two players could also declare the winner the first person to get any combination of pieces through three or five of the short or conventional game paths.

While the invention has been particularly shown and described with reference to a preferred embodiment thereof, it will be understood that the foregoing and other changes in form and details may be made therein without departing from the spirit and scope of the invention.

What is claimed is:

1. A school simulation game, imitative of teacher and student experience wherein players can assume teacher and student roles, comprising:

a game board having an upper surface;

at least a first type player game piece having the identity of a teacher representing a first type player;

at least a second type player game piece having the identity of a student representing a second type player;

a chance device partially determining movement of said game pieces of said game board;

a first plurality of sets of Hazard Cards for impeding the progress of a recipient first type player;

a second plurality of sets of Hazard Cards for impeding the progress of a recipient second type player;

a first plurality of sets of Benefit Cards for enhancing the progress of a recipient first type player;

a plurality of Influence Cards for altering a recipient Player's progress;

said game board further comprising:

a first circuitous path of player movement located on said upper surface, said first path including a first plurality of successive player landing sites thereafalong having instructions thereon;

first and second pluralities of individually unique paths respectively for said first and second type players;

each of said first plurality of paths having a first category of landing sites directing a player represented by one of said game pieces on one of said first category landing sites to draw one of a first particular one of said sets of said first plurality of sets of Hazard Cards;

said first category of landing sites of said first plurality of paths having an association with said first particular one of said sets of said first plurality of sets of Hazard Cards;

each of said first plurality of paths further having a second category of landing sites directing a player represented by one of said game pieces on one of said second category landing sites to draw one of a first particular one of said sets of said first plurality of sets of Benefit Cards;

said second category of landing sites of said first plurality of paths having an association with said first particular one of said first plurality of sets of Benefit Cards;

each of said second plurality of paths having a first category of landing sites directing a player represented by one of said game pieces of one of said first category landing sites to draw one of a first particular one of said sets of said second plurality of sets of Hazard Cards;

said first category of landing sites of said second plurality of paths having an association with said first particular one of said sets of said second plurality of sets of Hazard Cards;

each of said second plurality of paths having a second category of landing sites directing a player represented by one of said game pieces on one of said second category landing sites to draw one of a first particular one of said sets of said second plurality of sets of Benefit Cards; and said second category of landing sites of said second plurality of paths having an association with said first particular one of said second plurality of sets of Benefit Cards; and each of said first and second pluralities of paths having a third category of landing sites permitting a player represented by a piece on one of said third category of landing sites to influence another player by directing said another player to draw one of said Influence Cards.

2. A game in accordance with claim 1 wherein:

said first path comprising an external path; and said first and second pluralities of paths comprising internal paths.

3. A game in accordance with claim 2 wherein each card of each set of said first and second pluralities of Hazard Cards and said first and second pluralities of Benefit Cards being unexposed prior to being drawn.

4. A game in accordance with claim 1 wherein said game further comprising at least one player positioned hazard piece.

5. A game in accordance with claim 4 wherein said game further comprising a Mutual Sharing Path to be traveled by both said first type student-players and said second type teacher-players.

6. A game in accordance with claim 5 wherein:

each of said first and second pluralities of inner paths having a fourth category of sites permitting a player whose game piece is positioned thereon to be free from the influence of other players; and said fourth category of sites including sites having instructions thereon.

7. A game in accordance with claim 6 wherein said game further comprising:

first and second player positioned hazard pieces;

said first piece having a selective position on one of said landing sites of said second plurality of inner paths.

8. A game in accordance with claim 7 wherein said first, second, third and fourth categories of landing sites having random ordering on each of said respective first and second pluralities of inner paths.

9. A game in accordance with claim 8 wherein:

said first, second, third and fourth categories of sites having visual distinguishability; and each of said plurality of game pieces having visual distinguishability.

10. A game in accordance with claim 9 wherein said plurality of Influence Cards includes a first group to be drawn from by said first type student-players and a second group to be drawn from by said second type teacher-players; and each of said first and second group comprising a separate plurality of sub-groups each of which relates to a different type of influence.

* * * * *